US005790995A

United States Patent [19]

Caden et al.

[11] Patent Number: 5,790,995

[45] Date of Patent: Aug. 11, 1998

[54] AQUATIC LIFTING DEVICE

[76] Inventors: John Caden, 636 Sabol Palm Rd., Miami, Fla. 33137; Bernard Resch, Kelten Ring 14, 63128 Dietrenbach, Germany; Wolfgang Sander, Am Muehlberg 3, 61197 Florstadt, Germany

[21] Appl. No.: 872,267

[22] Filed: Jun. 10, 1997

[51] Int. Cl.[6] ..... A61G 7/10

[52] U.S. Cl. ..... 5/86.1; 5/87.1; 4/491

[58] Field of Search ..... 5/81.1 R, 83.1, 5/86.1, 87.1; 4/496, 560.1, 561.1, 562.1, 563.1

[56] References Cited

U.S. PATENT DOCUMENTS

| | | | |
|---|---|---|---|
| 3,203,009 | 8/1965 | Lundberg | 5/87.1 |
| 3,608,104 | 9/1971 | Van Gerven | 5/83.1 |
| 3,694,829 | 10/1972 | Bakker | 5/87.1 |
| 3,981,484 | 9/1976 | James | 5/496 X |
| 4,183,106 | 1/1980 | Grimes et al. | 5/496 X |
| 4,941,216 | 7/1990 | Boublil | 4/496 |
| 4,996,728 | 3/1991 | Nolan | 4/496 |
| 5,465,433 | 11/1995 | Nolan | 4/563.1 X |
| 5,560,053 | 10/1996 | Mills | 5/81.14 R |

*Primary Examiner*—Michael F. Trettel
*Attorney, Agent, or Firm*—Malloy & Malloy, P.A.

[57] ABSTRACT

An aquatic lifting device to lift a person into and out of a swimming pool or similar location, the lifting device includes a base with a mast segment coupled to and extending upwardly from the base. A pair of spaced apart support arms are pivotally coupled to the mast segment, with a transport assembly structured to support a person during pivotal movement of the support arms, secured at a first end of the support arms. A pivot assembly is provided and is structured to pivotally move the support arm relative to the mast segment so as to correspondingly raise and lower the transport assembly and the person supportably disposed thereon, and a plurality of casters are secured to the base so as to facilitate movement and re-positioning of the entire assembly. So as to maintain the base securely and stably positioned on an underlying support surface during pivotal movement of the support arm, whether a person is being lifted or not and thereby permitting independent, completely portable positioning of the base at any desired position on the underlying support surface, a counterweight assembly is further coupled to the base.

28 Claims, 3 Drawing Sheets

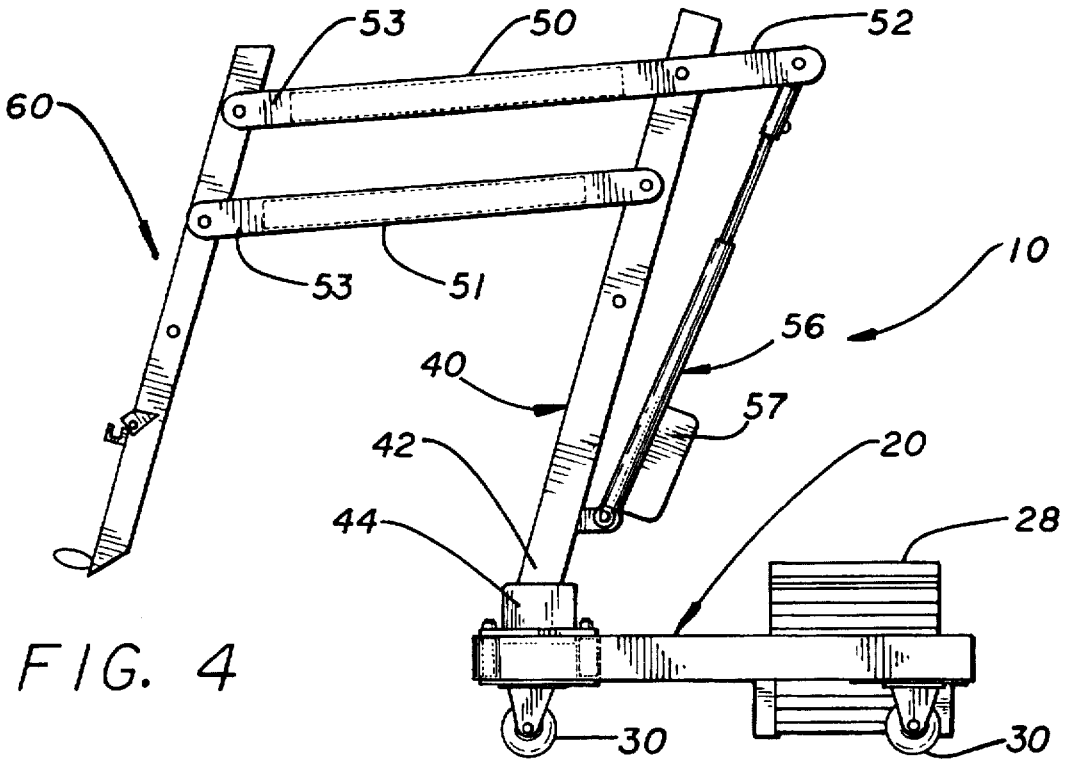
FIG. 4
FIG. 5
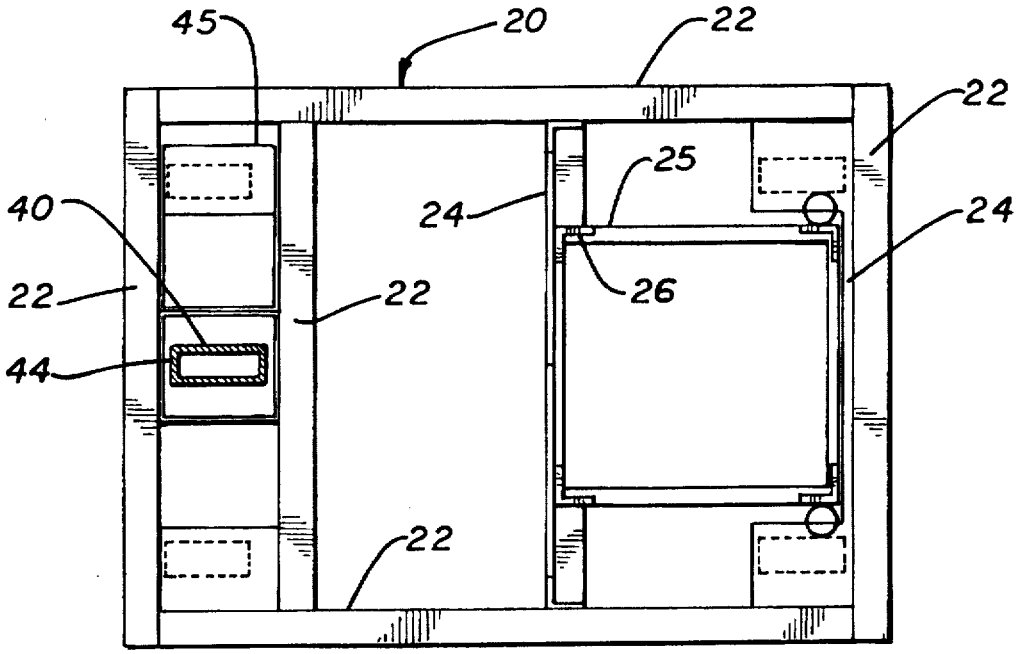

AQUATIC LIFTING DEVICE

BACKGROUND OF THE INVENTION

1. Field of the Invention

The present invention relates to an aquatic lifting device structured to provide individuals, and especially physically challenged individuals, access to swimming pools and the like, the aquatic lifting device being completely portable and not requiring any fixtures to be permanently or temporarily installed at a swimming pool site, thereby permitting convenient, multi-swimming pool use and effective storage and concealment when not actually needed.

2. Description of the Related Art

Swimming pools are widely utilized for recreational activities by many individuals on a daily basis. Moreover, swimming pools are seen as a great source for exercise and rehabilitation due to their ability to provide a source for a high resistance, non-impact workout. For these reasons, all individuals, including disabled individuals, frequently utilize swimming pools. A difficulty, however, arises when a physically challenged individual desires to utilize the pool. Specifically, due to their physical limitations, such individuals are not able to enter swimming pools in a conventional fashion, and as a result require special assistance in order to be lowered and subsequently removed from the swimming pool. Indeed, such manipulation of a physically challenged individual is quite difficult, even if a number of other individuals are available to assist with entering and exiting the swimming pool. As such, many facilities which are accustomed to dealing with handicapped or rehabilitating individuals have installed elaborate platforms and/or harnesses to provide for the lowering and raising of an individual into and out of a swimming pool. Unfortunately, however, because such fixtures are often large, bulky and expensive, as they must necessarily extend out over the edge of the pool holding a substantial weight, only those special, dedicated facilities generally have such fixtures available. For example, swimming pools at clubs, resorts, hotels and other public recreational localities generally do not have the large built-in fixtures available because they tend to detract from the overall attractive appearance of the swimming pool area, they are not used sufficiently to warrant the added expenses, and there is generally insufficient room to provide such a fixed assembly without creating a hazard to other individuals playing in the vicinity of the swimming pool. As a result, very limited access for rehabilitating or other physically challenged individuals has been evidenced to date.

Recent legal developments, however, such as the passing of the Americans with Disability Acts ("ADA") have begun to change the minimum accessibility requirements of such facilities. In particular, despite the infrequent usage of handicapped access features, public locations will likely be required to include appropriate amenities to assist handicapped and/or physically disabled individuals. Accordingly, all public swimming pool locations will soon be required to install some sort of assembly to provide for the facilitated access of such physically challenged individuals into their swimming pools. Presently, the only available option for such facilities is the use of a large, bulky permanent fixture such as those presently being utilized at the specialized facilities. As indicated, due to the limitations of known devices and the weight that must be transported over the edge of the swimming pool, the permanent nature of existing types of devices/fixtures is a general requirement. Accordingly, there is a need for an aquatic lifting device which is structured to facilitate the introduction and removal of physically challenged individuals in to and out of swimming pools, but which is cost effective to provide, is safe and stable, and does not require the construction of any permanent, pool side structure. Specifically, such an aquatic lifting device should preferably be completely portable, thereby permitting facilities with multiple swimming pools to maintain only one such device, and should be easily storable, thereby allowing the device to be kept out of the way until actually needed and preserving the aesthetic integrity of the swimming area without creating a hazard to other individuals playing pool side. The device of the present invention provides such an effective and safe assembly which meets the goals of the ADA and helps provide a greater degree of access by physically challenged individuals to swimming pools.

SUMMARY OF THE INVENTION

The present invention is directed towards an aquatic lifting device to be utilized to lift individuals in to and out of a swimming pool. Specifically, the aquatic lifting device includes a preferably large, stable base, with a mast segment coupled thereto and extending upwardly therefrom. Further, pivotally coupled to the mast segment is at least one support arm. The support arm is structured to hold and retain a transport assembly at a first end thereof.

In particular, the transport assembly is structured to support a person during pivotal movement of the support arm relative to the mast segment. As such, when the first end of the pivot arm is raised and lowered relative to the mast segment, the person on the transport assembly is correspondingly raised and lowered relative to the mast segment. Moreover, a pivot assembly is provided and functions to actually pivot the support arm relative to the mass segment so as to correspondingly raise and lower the transport assembly and the person supportably disposed thereon. Specifically, the pivot assembly provides for controlled regulated pivotal movement of the support arm so as to eliminate abrupt movement in to and out of the swimming pool.

Also included with the aquatic lifting device and coupled to the base are positioning means. The positioning means are structured to facilitate movement and repositioning of the base, thereby maintaining the portability of the assembly. Furthermore, disposed on the base is a counterweight assembly. The counterweight assembly is structured to maintain the base securely and stably positioned on an underlying support surface during pivotal movement of the support arm to raise and lower the person on the transport assembly. As such, the counterweight assembly permits variable positioning of the base at any desired location on the underlying support surface, without requiring a permanent fixture or mounting structure be present in the underlying support surface.

It is an object of the present invention to provide an aquatic lifting device which is completely self contained and portable.

Still another object of the present invention is to provide an aquatic lifting device which can effectively lower and raise an individual in to and out of a swimming pool in a safe, stable and secure manner.

A further object of the present invention is to provide an aquatic lifting device which can raise and lower an individual, but does not require the construction of a permanent fixture at a location of use, such as at a side of a swimming pool, in order to provide for the stable, balanced movement of an individual.

Still another object of the present invention is to provide an aquatic lifting device which can be easily stored in an out of the way location until necessary for use.

A further object of the present invention is to provide an aquatic lifting device which is substantially sturdy and durable.

These and other objects, features, and advantages of the present invention will become more readily apparent from the attached drawings and the detailed description of the preferred embodiments, which follow.

BRIEF DESCRIPTION OF THE DRAWINGS

For a fuller understanding of the nature of the present invention, reference should be had to the following detailed description taken in connection with the accompanying drawings in which:

FIG. 4 is a side view of an embodiment of the aquatic lifting device of the present invention illustrating the counterweight assembly; and FIG. 5 is a top, cross section view illustrating the base of the aquatic lifting device of the present invention.

Like reference numerals refer to like parts throughout the several views of the drawings.

DETAILED DESCRIPTION OF THE PREFERRED EMBODIMENT

Figure 1:
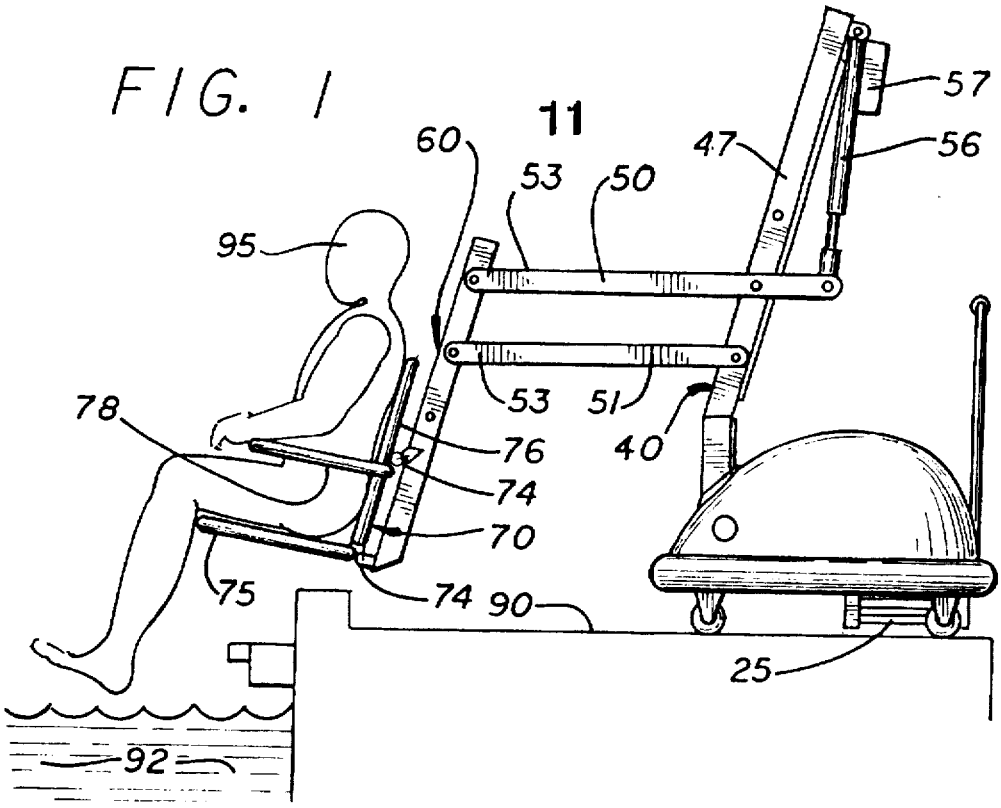
FIG. 1 is a side view of an embodiment of the aquatic lifting device of the present invention illustrating the raising and/or lowering of a person.
Figure 2:
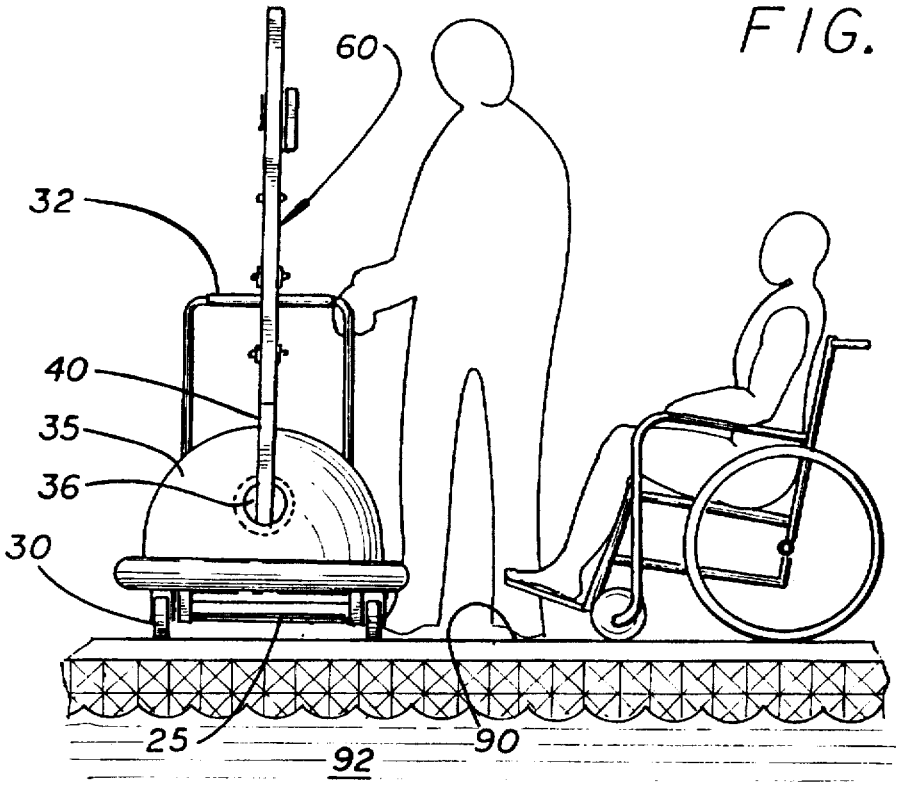
FIG. 2 is a front view of the aquatic lifting device of the present invention.

Shown throughout the Figures, the present invention is directed towards an aquatic lifting device, generally indicated as 10. Specifically, the aquatic lifting device 10 is structured to lift an individual 95 for facilitated access to a location such as a swimming pool 92. In its preferred configuration, the aquatic lifting device 10 is preferably configured such that it will elevate the person 95 above an underlying support surface 90, thereby clearing any obstacles or ledges which surround the swimming pool 92, and thereafter lower the individual into the swimming pool 92, to a point below a plane the underlying support surface 90.

The aquatic lifting device 10 of the present invention includes a base 20. The base 20 is formed of substantially strong, rigid and durable construction, and in the preferred embodiment includes a series of support bars 22 secured with one another so as to define the strong stable base 20. Coupled to the base and structured to facilitate movement and repositioning of the base 20, both when in use to raise and/or lower a person 95 or when moved to a desired use or storage location, are positioning means. In the preferred embodiment, the positioning means includes a plurality of downwardly depending casters 30 extending preferably from an underside of the base 20. The casters 30 are formed of a sufficiently strong durable construction capable of permitting movement even when weighted down by a substantial load, and indeed the casters 30 may be directly coupled to the base 20, or may be part of an underlying roller platform on which the base 20 is positioned. Of course, if desired, the positioning means may include a wide variety of wheels and rollers, as well as skid plates or any other mechanism to facilitate movement of a heavy object. Moreover, a wheel lock or other movement resisting assembly may be incorporated for selective deployment, such as on a sloped surface. Extending upwardly from the base 20, and further provided as part of the positioning means, is a handle assembly 32. The handle assembly 32 is securely disposed in an easily graspable orientation and is structured to facilitate the pushing and/or pulling of the base 20, and therefore the entire aquatic lifting device 10, to a desired pool side location.

Also extending upwardly from the base 20 is a mast segment 40. Specifically, the mast segment 40 is preferably a substantially strong, rigid segment that is securely coupled to the base 20, preferably at a front end of the base 20. Moreover, while the mast segment 40 may include one or more rigid members, preferably a single, high strength, tubular bar will be sufficient. Also in the preferred embodiment, the mast segment 40 includes an upper region 47. In this preferred embodiment, at least that upper region 47 is angled towards the rear of the base 20. Furthermore, the upper region 47 of the mast segment 40 is preferably disposed at an angle of appropriately 15 degrees from vertical, thereby urging the center of gravity of the aquatic lifting device 10 more towards a center of the base 20.

Pivotally coupled to the mast segment 40 is at least one, but preferably a pair of support arms 50 and 51. The support arms 50 and 51 are strong rigid segments, and may be of a preferred rigid tubular configuration much like that of the mast segment 40. The support arms 50 and 51 are disposed in generally spaced apart, generally parallel relation with one another, and are preferably pivotally mounted, utilizing a transverse bolt, joint pin, or other conventional assembly for providing pivotal interconnection, to the mast segment 40. As such, the support arms 50 and 51 are able to vertically pivot relative to the mast segment 40, such that a front end 53 thereof is raised and lowered relative to the underlying support surface 90. One of the support arms 50 and 51, and preferably the upper support arm 50 also preferably includes a cantilever segment 52. The cantilever segment 52 extends beyond the mast segment 40 and is structured to be pushed up or down to provide for corresponding pivotal movement of the support arms 50 and 51 and a transport assembly 60 disposed at the front end 53 of the support arms 50 and 51.

In particular, the aquatic lifting device 10 of the present invention also includes a transport assembly 60 which is structured to support a person 95 thereon during upward and downward pivotal movement. In the preferred embodiment, the transport assembly 60 includes at least one, but possibly a pair of generally strong support segments 61 coupled to the support arms 50 and 51, and preferably extending downwardly therefrom.

This support segment 61 is also preferably pivotally coupled to the support arms 50 and 51 such that it may maintain its generally vertical orientation during lifting and lowering thereof. Indeed, it is seen that the support segment 61 is generally parallel to the mast segment 40, thereby maintaining a proper, stable orientation of the person 95 during all phases of lifting or lowering.

Figure 3:
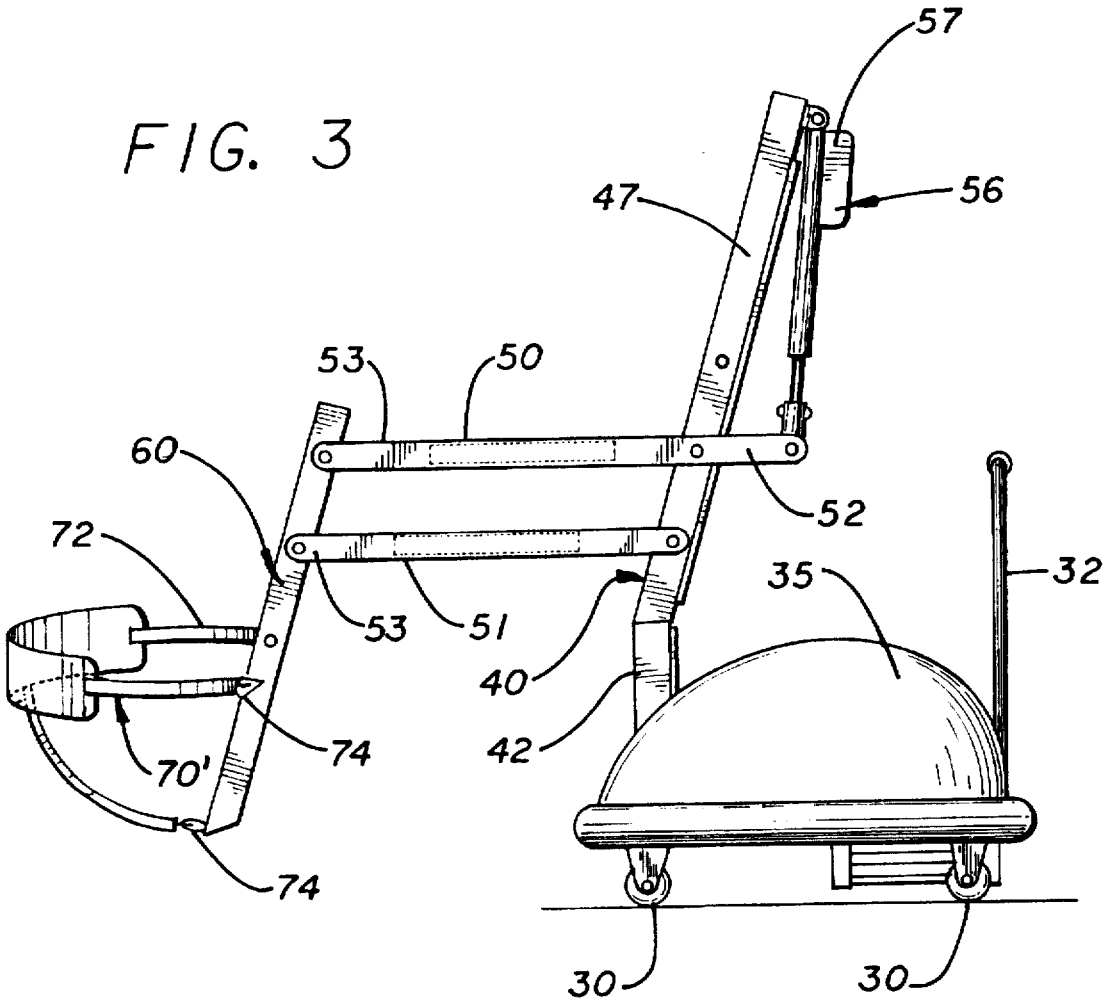
FIG. 3 is a side view of a preferred embodiment of the aquatic lifting device of the present invention.

Looking to the embodiment of FIG. 3, the transport assembly 60 may also include a harness 70'. The harness 70' is structured to be secured to the support segment 61 and to the person 95 being raised and lowered. In particular, such a harness 70' is preferably of the type that includes a seat portion 72, and is fastened to the support segment 61, such as at a pair of hooks or clips 74 on the support segment 61, thereby maintaining a consistent orientation of the person 95 being held by the harness, while also provide a secure and comfortable hold of the person 95. Moreover, such a harness 70' should also preferably be weighted in order to ensure that convenient entry into the harness is available within the water. In the preferred embodiment of the present invention, however, as illustrated in FIG. 1, the transport assembly 60 preferably includes a support platform 70. The support platform 70 is structured to be secured to the support segment 61 in a rigid, stable fashion so that it extends outwardly away from the support segment 61. In particular, the support platform 70 is preferably configured much like a chair and thereby includes a base 75 and a back 76 in order to permit the person 95 to conveniently sit thereon during raising and lowering thereof into the swimming pool 92. Moreover, one or more guide rails 78 may also be provided and disposed at opposite sides of the support platform 70, with preferably at least one of the guide rails 78 being movably connected so to facilitate access by the person 95 onto the support platform 70. In this regard, the guide rail 78 may be removable or merely retractable, as necessary. The preferred base 75 and/or the back 76 of the support platform 70 are preferably fixedly secured to the support segment 61, such as by welding or a secure bracket, however some release mechanism may be incorporated to remove the support platform 70 entirely or to tilt the support platform 70 if assistance for entering and exiting the swimming pool 92 is required by the person 95 sitting thereon. Also a harness or seat belt type configuration may be provided during the actual lifting stages.

From the foregoing it is seen that as the support arms 50 and 51 correspondingly pivot up and down relative to the mast segment 40, the transport assembly 60, and therefore the person 95 sitting thereon, are corresponding raised and lowered. As such, when the person 95 initially loads onto the aquatic lifting device 10, the transport assembly 60 is preferably disposed at or above the underlying support surface, and thereafter is lifted slightly, if clearance over a swimming pool 92 lip or other obstacle is required. Once positioned over the water, the transport assembly 60 is then lowered into the swimming pool 92. Therefore, the person 95 disposed in the transport assembly 60, may exit the transport assembly 60 well within the water of the swimming pool 92, being aided by their natural buoyancy. Of course, the same procedure in reverse can be effectuated to provide for removal of the person 95 from the swimming pool 92.

From the preceding description, it is noted that a preferred loading and unloading point of the person 95 on the underlying support surface 90 is at a point pool side, adjacent a point of entry or exit within the swimming pool 92. Although the person 95 could be loaded at the pool edge directly next to the pool entry point, with the base 20 being pushed towards or away from the pool to achieve proper positioning of the transport assembly 60, in the preferred embodiment the loading point will be at a side of the base 20 that does not confront the swimming pool 92. Along these lines, and looking once again to the mast segment 40, it is preferably swivelably secured to the base 20 at a swivel platform 44. As such, the base 20 may be positioned substantially near an edge of the swimming pool 92 and the mast segment 40 swiveled to provide easier access to the transport assembly 60 on the underlying support surface 90. Once the person 95 is disposed on the transport assembly 60, the transport assembly 60 is raised and the mast segment 40 is swivelled back to a normal position such that it will overlie the swimming pool 92 and effective raising and/or lowering can be correspondingly achieved. Moreover, while manual swiveling of the mast assembly 40, and therefore the support arms 50 and 51 and the transport assembly 60 may be provided, preferably a gear box 45 is further mounted to the base 20 and provides for automatic swiveling of the base segment 40 relative to the base 20.

As indicated, the support arms 50 and 51 are structured to pivot relative to the mast assembly 40. In order to effectively and pivotally move the support arms 50 and 51 relative to the mast segment 40, and thereby so as to correspondingly raise and lower the transport assembly 60 and the person 95 supportably disposed thereon, the aquatic lifting device 10 of the present invention further includes a pivot assembly 56. Specifically, the pivot assembly 56 is preferably mounted to the mast segment 40, preferably at a point above the support arms 50 and 51, although mounting to the base 20 or to the mast segment 40 at a point below at least one of the support arms may be provided as illustrated in FIG. 4. As such, in the preferred embodiment, the pivot assembly 56 is structured to push down on the cantilever segment 52 of the support arm 50 in order to correspondingly cause upward movement of the transport assembly 60 and lifting of the person 95. Conversely, the pivot assembly 56 is structured to either pull, or merely release, in a preferably controlled fashion, the cantilever segment 52, thereby allowing upward movement thereof, under the normal effects of gravity, and causing corresponding downward movement of the transport assembly 60, when the person 95 is to be lowered. In the preferred configuration, the pivot assembly 56 is structured to raise the transport assembly 60 approximately one meter, but possibly two or more, above the underlying support surface 90, thereby allowing for sufficient clearance over a lip of the swimming pool 92 and/or providing usage of the aquatic lifting device 10 in other applications. While it is understood that the pivot assembly 56 may include a number of mechanisms to actually perform the corresponding pushing and/or pulling of the support arm 50, in the preferred embodiment of the present invention, the pivot assembly 56 includes a piston assembly. The piston assembly, which may include a number of different interior mechanisms 57 to provide for effective, controlled and powered actuation of thereof, may be hydraulically or mechanically actuated, or may include a rotating spindle assembly disposed therein in a conventional manner, to define the interior mechanism 57 of the pivot assembly 56. It is seen, however, that in order to maintain proper alignment during movement of the support arms 50 to which it is coupled, the pivot assembly 56 may also be at least partially hingedly and/or pivotally secured to the support arm 50.

The aquatic lifting device 10 of the present invention is structured to be completely portable and require no modification of the underlying support surface 90 of the swimming pool 92 in order to provide effective functioning thereof. Indeed, the aquatic lifting device 10 of the present invention is structured to be conveniently and compactly stored in an out of the way location until actual use is desired. In this regard, the aquatic lifting device 10 of the present invention further includes a counterweight assembly. Specifically, the counterweight assembly is mounted to the base 20 and is structured to maintain the base 20 securely and stably positioned on the underlying support surface 90 during pivotal movement of the support arms 50 and 51, through their full range of pivotal movement, whether loaded or unloaded by a person 95 sitting in the transport assembly 60. In the preferred embodiment, the counterweight assembly includes a plurality of heavy, preferably metallic, plates 28 disposed on the base 20, for example, the preferred configuration includes twenty four, 261*b* plates 28. Of course, any other heavy weighted article or material construction plates may be equivalently utilized. In this preferred embodiment, a pair of support brackets 24 are mounted to the base 20, and a support frame 25 is secured thereto to provide for effective supportability of the plates 28 or other counterweight item. Moreover, a series of side brackets 26 are preferably provided so as to provide for stable and centered positioning of the plates 28. As illustrated in FIG. 4, the support frame 25 is preferably structured to extend beneath a plane of the base 20 such that the plurality of heavy plates 28, or other weight may extend through the plane of the base 20 to provide a greater degree of leverage. Still, however, it is preferred that the support frame 25 be elevated slightly above a contact point between the casters 30 and the underlying support surface 90 such that rolling of the aquatic lifting device 10 will not be hindered thereby.

In order to provide an attractive aesthetic appearance, a protective cowling 35 may be provided to cover the counterweight assembly and protect them from tampering. Further, the cowling 35 also preferably contains the swivel platform 44 and therefore includes an opening 36 through which the mast segment 40 protrudes and through which it is allowed to pivot. The handle assembly 32 of the positioning means will also preferably extend outside of the protective cowling 35 as it must be exteriorly manipulated for transport and portability of the aquatic lifting device 10. Additionally, if desired, retractable supports or another stabilizing mechanism may also be mounted to the base 20 for deployment once the base 20 is positioned at a desired location for raising and lowering a person 95.

As to the controls of the present invention, such as for controlling the movement of the pivot assembly or the swiveling of the mast segment, a control panel may be provided. This control panel can be mounted to the base or cowling, and indeed, may provide for actuation directly by the individual being lowered or raised into the swimming pool. Accordingly, one or more controls may be provided, some of which may be water resistant.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An aquatic lifting device comprising:

a base, a mast segment coupled to said base and extending upwardly therefrom, at least one support arm pivotally coupled to said mast segment, a transport assembly disposed at a first end of said support arm, said transport assembly structured to support a person during pivotal movement of said support arm, a pivot assembly structured to pivotally move said support arm relative to said mast segment so as to correspondingly raise and lower said transport assembly and the person supportably disposed thereon, positioning means coupled to said base and structured to facilitate movement and re-positioning of said base, and a counterweight assembly coupled to said base and structured to maintain said base securely and stably positioned on an underlying support surface during pivotal movement of said support arm, thereby permitting variable positioning of said base on the underlying support surface.

2. An aquatic lifting device comprising:

a base, a mast segment coupled to said base and extending upwardly therefrom, at least one support arm pivotally coupled to said mast segment, a transport assembly disposed at a first end of said support arm, said transport assembly structured to support a person during pivotal movement of said support arm, a pivot assembly structured to pivotally move said support arm relative to said mast segment so as to correspondingly raise and lower said transport assembly and the person supportably disposed thereon, positioning means coupled to said base and structured to facilitate movement and re-positioning of said base, and a counterweight assembly coupled to said base and structured to maintain said base securely and stably positioned on an underlying support surface during pivotal movement of said support arm, thereby permitting independent, completely portable positioning of said base at any desired position on the underlying support surface.

3. An aquatic lifting device as recited in claim 2 wherein said positioning means includes a plurality of downwardly depending casters secured to said base.

4. An aquatic lifting device as recited in claim 3 wherein said positioning means further includes a handle assembly coupled to said base so as to facilitate movement of said base on said casters.

5. An aquatic lifting device as recited in claim 2 wherein said mast segment is manually swivelably secured to said base.

6. An aquatic lifting device as recited in claim 2 wherein said mast segment is automatically swivelably secured to said base.

7. An aquatic lifting device as recited in claim 2 wherein said mast segment includes an upper region that is generally angled away from said transport assembly.

8. An aquatic lifting device as recited in claim 7 wherein said upper region of said mast segment is disposed at an angle of generally about fifteen degrees from vertical.

9. An aquatic lifting device as recited in claim 2 including two of said support arms, each of said support arms being pivotally secured to said mast segment in generally spaced apart, generally parallel relation from one another.

10. An aquatic lifting device as recited in claim 2 wherein said support arm includes a cantilever segment that extends beyond said mast segment, said cantilever segment being coupled to said pivot assembly such that downward movement of said cantilever segment by said pivot assembly results in upward movement of said transport assembly, and upward movement of said pivot assembly results in downward movement of said transport assembly.

11. An aquatic lifting device as recited in claim 2 wherein said pivot assembly is structured to raise said transport assembly approximately one meter above the underlying support surface.

12. An aquatic lifting device as recited in claim 2 wherein said transport assembly includes a support segment pivotally coupled to said support arm and extending downwardly therefrom.

13. An aquatic lifting device as recited in claim 12 wherein said transport assembly further includes a harness secured to said support segment and structured to hold the person being raised and lowered.

14. An aquatic lifting device as recited in claim 12 wherein said transport assembly further includes a support platform secured to said support segment and disposed so as to permit the person being raised and lowered to sit thereon during raising and lowering of said transport assembly.

15. An aquatic lifting device as recited in claim 14 wherein said transport assembly further includes guide rails secured at opposite sides of said support platform, at least one of said guide rails being movably disposed so as to facilitate access by the person being raised and lowered onto said support platform.

16. An aquatic lifting device as recited in claim 2 wherein said mast segment extends above said support arm.

17. An aquatic lifting device as recited in claim 16 wherein said pivot assembly is mounted to said mast segment at a point above said support arm.

18. An aquatic lifting device as recited in claim 17 wherein said pivot assembly is structured to push down on said support arm so as to raise said transport assembly.

19. An aquatic lifting device as recited in claim 18 wherein said pivot assembly is structured to gradually and selectively release downward pressure on said support arm so as to gradually and selectively lower said transport assembly.

20. An aquatic lifting device as recited in claim 2 further including a protective cowling disposed over said counterweight assembly.

21. An aquatic lifting device as recited in claim 2 wherein said counterweight assembly includes a plurality of heavy plates disposed on said base.

22. An aquatic lifting device as recited in claim 21 wherein said base includes a support frame structured to receive said plurality of heavy plates.

23. An aquatic lifting device as recited in claim 22 wherein said support frame is structured to extend beneath said base such that said plurality of heavy plates are disposed up through a plane of said base.

24. An aquatic lifting device as recited in claim 2 wherein said pivot assembly includes a piston assembly.

25. An aquatic lifting device as recited in claim 24 wherein said piston assembly is hydraulically actuated.

26. An aquatic lifting device as recited in claim 24 wherein said piston assembly is mechanically actuated.

27. An aquatic lifting device as recited in claim 24 wherein said pivot assembly includes a spindle assembly.

28. An aquatic lifting device as recited in claim 2 wherein said pivot assembly is mounted at a point below a coupling point of said support arm to said mast segment.

* * * * *

UNITED STATES PATENT AND TRADEMARK OFFICE

CERTIFICATE OF CORRECTION

PATENT NO. : 5,790,995

DATED : August 11, 1998

INVENTOR(S) : John Caden, Bernhard Resch, Wolfgang Sander

It is certified that error appears in the above-indentified patent and that said Letters Patent is hereby corrected as shown below:

On the title page, item [75], line 2, delete "Sabol" and insert therefore --Sabal--; line 3, delete "Bernard" and insert therefore --Bernhard--; line 4, delete "Kelten Ring" and insert therefore --Keltenring--; line 4, delete "Dietrenbach" and insert therefore --Dietzenbach--.

Signed and Sealed this

Twenty-seventh Day of April, 1999

*Attest:*

Q. TODD DICKINSON

*Attesting Officer*

*Acting Commissioner of Patents and Trademarks*